US011340034B1

(12) United States Patent
Yudys et al.

(10) Patent No.: US 11,340,034 B1
(45) Date of Patent: May 24, 2022

(54) DUAL LEVER AND REVERSIBLE SAFETY SELECTOR HAVING BOTH REGULAR AND SHORT THROW OPTIONS AND INCLUDING ROUNDED MULTI-SIDED END RECESSES FOR RECEIVING MATING PROTRUSIONS CONFIGURED IN EACH OF THE ATTACHABLE LEVERS

(71) Applicant: 22 Evolution LLC, Columbia, MO (US)

(72) Inventors: Joshua Thomas Yudys, Columbia, MO (US); Philip Robert DiMuzio, Columbia, MO (US); John L. Overstreet, Fayette, MO (US)

(73) Assignee: 22 Evolution LLC, Columbia, MO (US)

( * ) Notice: Subject to any disclaimer, the term of this patent is extended or adjusted under 35 U.S.C. 154(b) by 0 days.

(21) Appl. No.: 17/327,101

(22) Filed: May 21, 2021

(51) Int. Cl.
*F41A 17/46* (2006.01)
*F41A 35/06* (2006.01)

(52) U.S. Cl.
CPC ..... *F41A 17/46* (2013.01); *F41A 35/06* (2013.01)

(58) Field of Classification Search
CPC ..... F41A 35/06; F41A 17/52; F41A 17/46
USPC ..... 89/148; 42/70.06
See application file for complete search history.

(56) References Cited

U.S. PATENT DOCUMENTS 8,276,502 B1 10/2012 Wright
8,756,847 B2 * 6/2014 Huther ..... F41A 35/06 42/70.04
8,806,790 B1 8/2014 Huang et al.
9,557,128 B2 1/2017 Miller, III
9,562,733 B2 2/2017 Huther
9,587,897 B1 3/2017 Huang et al.
10,126,086 B2 11/2018 Smith
D841,755 S 2/2019 Pavlick
10,466,001 B1 11/2019 Huang et al.
10,670,367 B1 6/2020 Boyer et al.
10,767,949 B2 9/2020 Zung et al.
10,816,296 B2 10/2020 Karchon et al.
D904,854 S 12/2020 Huang et al.
10,866,049 B2 12/2020 Werner
11,085,720 B2 * 8/2021 Nguyen ..... F41A 17/52
2005/0241470 A1 11/2005 Hochstrate et al.
2007/0180984 A1 8/2007 Huther
2020/0033088 A1 1/2020 Nguyen

* cited by examiner

*Primary Examiner* — Reginald S Tillman, Jr.
(74) *Attorney, Agent, or Firm* — Dinsmore & Shohl LLP

(57) ABSTRACT

A dual lever ambidextrous and reversible safety selector switch for a firearm having a central rotatable component pivotally mountable through a transverse directed aperture in a lower receiver of the firearm for selective rotation relative the receiver. First and second circumferential slots are configured within opposite sides of the component, each of the slots exhibiting a seating detent located at each of opposite ends so that a spring loaded detent pin in the lower receiver seats within one of the configured slots for displacement between the end detents between each of "safe" and "fire" configurations. At least one end face of the component has either a recessed or projecting shape with a pair of acute angled corners. A pair of control levers are provided, with at least one lever attaching to the end face of the component, so that either lever can be manipulated from either side of the lower receiver for actuating the selector.

16 Claims, 11 Drawing Sheets

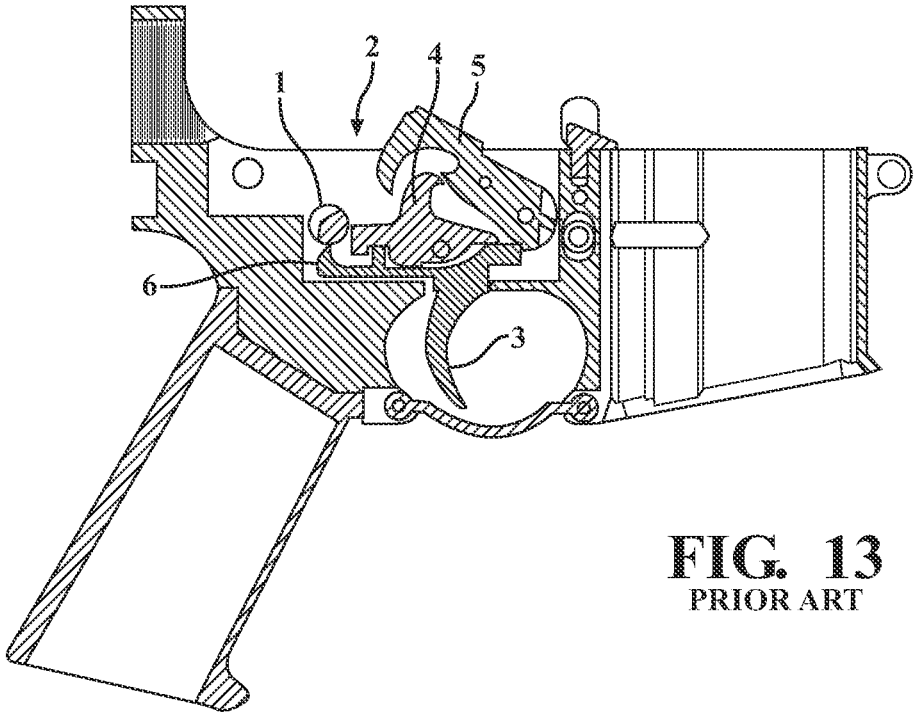
FIG. 13
PRIOR ART
FIG. 14
PRIOR ART
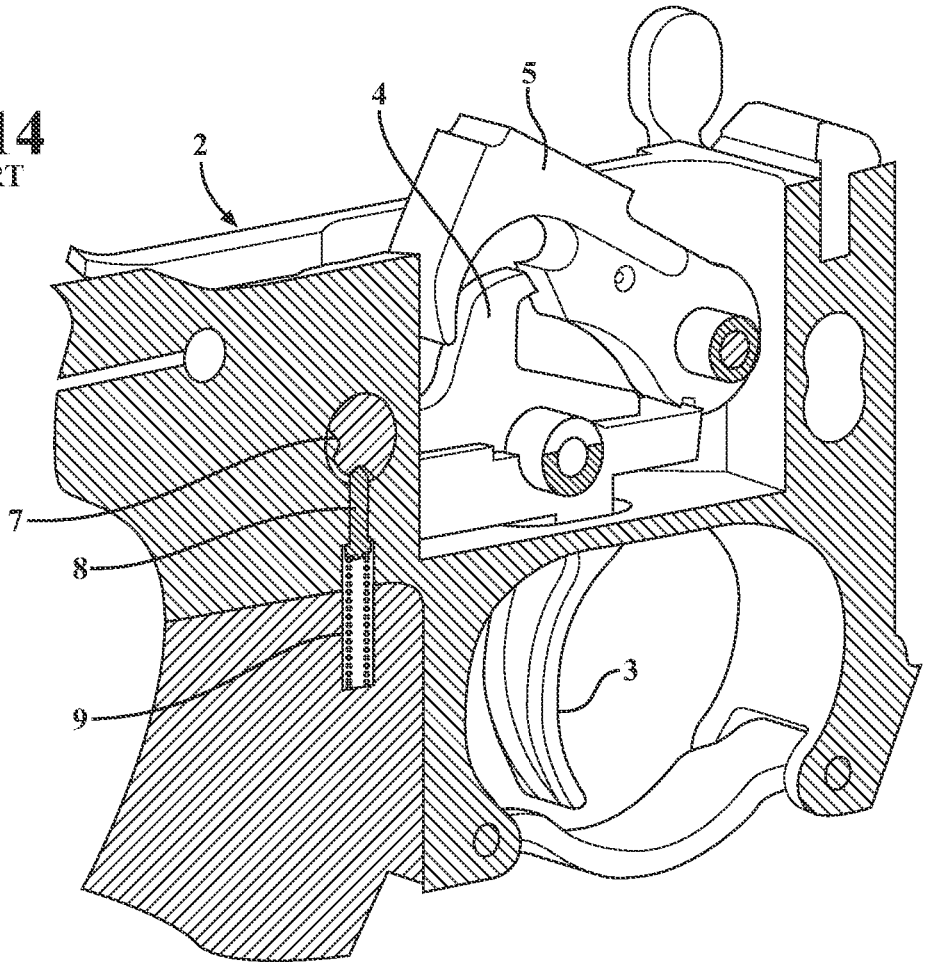

DUAL LEVER AND REVERSIBLE SAFETY SELECTOR HAVING BOTH REGULAR AND SHORT THROW OPTIONS AND INCLUDING ROUNDED MULTI-SIDED END RECESSES FOR RECEIVING MATING PROTRUSIONS CONFIGURED IN EACH OF THE ATTACHABLE LEVERS

FIELD OF THE INVENTION

The present invention relates generally to reversible safety selectors, such as for use in AR type firearms. More specifically, the present invention discloses a dual lever and reversible safety selector, such as providing either of a standard 90° degree or short throw 60° degree movement between "safe" and "fire" positions.

BACKGROUND OF THE INVENTION

A safety selector is commonly utilized in AR type firearms and operates by rotation of a lever 90 from a "safe" position to the "fire" position. In the "safe" position, an internal rotatable shaft of the selector blocks movement of a rearwardly extending portion of a trigger. When rotated to the "fire" position, any of a flat or recessed portion of the shaft is positioned over the rearwardly extending portion of the trigger member, thereby allowing actuating movement of the trigger, such as to fire a cartridge within the chamber.

Standard AR type firearms include a safety selector having a single actuation lever, typically located on the left side of the firearm receiver. The prior art also discloses ambidextrous safety selectors which attach a second actuation lever on an opposite end of the selector shaft to provide actuation from either side of the lower receiver. Such reversible selectors can be further adapted in alternate configurations to operate at both standard or regular throw (generally defined as a 90° rotation between safe and fire positions), as well as a reversible or short throw of less than the standard 90° angular throw.

With reference to the prior art view of FIG. 13 a cutaway plan view is shown of an existing AR type lower receiver incorporating a safety selector 1 in the trigger group of a lower AR type receiver 2. As shown, the receiver 2 incorporates a fire control mechanism including each of a trigger 3, a disconnector 4, a hammer 5, and associated springs (not shown). The trigger 3 includes a rearwardly-extending portion 6 which is engaged by the rotatable safety selector in the engaged or "safe" position preventing pivotal movement of the trigger 3.

With further reference to the prior art cutaway perspective view of FIG. 14, the safety selector is removed to reveal the transverse opening 7 in the lower receiver through which the central portion of the selector is seated. A detent pin 8 is biased upwardly by a spring 9 and is positioned to engage within a circumferentially directed slot configured upon the exterior of the central selector portion and so that the detent pin travels within the slot during rotation of the selector between "safe" and "fire" positions.

SUMMARY OF THE INVENTION

The present invention discloses a dual lever ambidextrous and reversible safety selector switch for a firearm. The selector includes a central and pseudo-cylindrical shaped control shaft which is pivotally mountable in a lower receiver of such as an AR type firearm for selective rotation about a widthwise or transverse axis extending through the receiver.

The central shaft includes each of first and second arcuate slots configured along opposite ends. Each of the slots exhibit a seating detent located at each of opposite ends of the circumferential extending are and, depending upon the mounting configuration of the selector within the lower receiver, will permit a selected angular range of rotation (e.g. standard 90° degree throw in a first mounting configuration or a modified short throw rotatable only 60° in a second mounting configuration) at which a spring loaded detent pin in the lower receiver seats within one of the configured slots for displacement between the detents. The central shaft selector further includes an angular profile provided by a pair of angled faces or surfaces positioned between the arcuate ninety and sixty degree end slots and, depending upon the adjusted rotational position of the selector, will either obstruct or provide the necessary clearance for the rear extending portion of the trigger (not shown) for in turn actuating the disconnector and hammer components of the lower receiver trigger group in order to discharge a cartridge in the attached upper receiver of the AR style firearm.

A pair of control levers are provided for attaching to opposite ends of the central shaft shaped selector and so that either lever can be manipulated from either side of the lower receiver for actuating the selector. The opposite end faces of the central selector cylinder or drum each further exhibit a recessed and internal multi-sided profile, such as a diamond "pseudo slot" shape, with rounded corners which can further exhibit both of equal or unequal lengths. The attachable lever or levers (one can be integrated into the central shaft component) further includes a mating interior facing projection which, upon seating within the diamond shaped slot, receives an externally threaded screw for attachment to mating threads configured within aligning apertures defined in at least the central selector. As will be further described, the arrangement of the opposing multi-sided or diamond end projections and recesses can be reversed so that the projections extend from the ends of the cylinder and the seating recesses are configured into the opposing seating locations of the lever(s).

When the selector is installed in the lower receiver, the spring loaded detent pin in the receiver engages a selected one of the detent grooves to prevent rotation. In the first standard throw installed configuration, and upon exerting a specified force upon the lever to unseat the spring loaded pin from an end located detent in the first arcuate slot corresponding to the "safe" position, rotation of the shaft is permitted between "safe" and "fire" positions over ninety degrees of rotation. Alternatively, and when the selector is removed and re-installed in a reversed arrangement, the spring loaded pin seats within a corresponding end detent of the second arcuate slot, following which rotation of the selector is permitted over a reduced or short throw travel of sixty degrees, at which the spring loaded pin seats within a second end located detent.

BRIEF DESCRIPTION OF THE DRAWINGS

Reference will now be made to the attached drawings, when read in combination with the following detailed description, wherein like reference numerals refer to like parts throughout the several views, and in which:

FIG. 13 is a cutaway plan view according to the known art and depicting an existing AR type lower receiver incorporating a safety selector in the trigger group of a lower AR type receiver;

FIG. 14 presents a further prior art cutaway perspective view of a lower receiver according to the known art in which the safety selector is removed to reveal the transverse opening in the lower receiver through which the central portion of the selector is seated, with the detent pin biased upwardly to engage the central selector portion and so that the detent pin travels within the slot during rotation of the selector between "safe" and "fire" positions;

DETAILED DESCRIPTION OF THE PREFERRED EMBODIMENTS

With reference to the attached illustrations, the present invention discloses a safety selector for AR type firearms that is reversible between a first configuration in which it provides an approximately ninety degree rotational switch between "safe" and "fire" positions, and a second orientation in which the same device will provide an approximately sixty degree selection between "safe" and "fire" positions. Without limitation "AR" type firearms are interpreted to include variants of the AR15 and AR10-platform firearms, whether in a rifle or pistol configuration and without respect to what other accessories or features may be included on or in the firearm.

Figure 1:
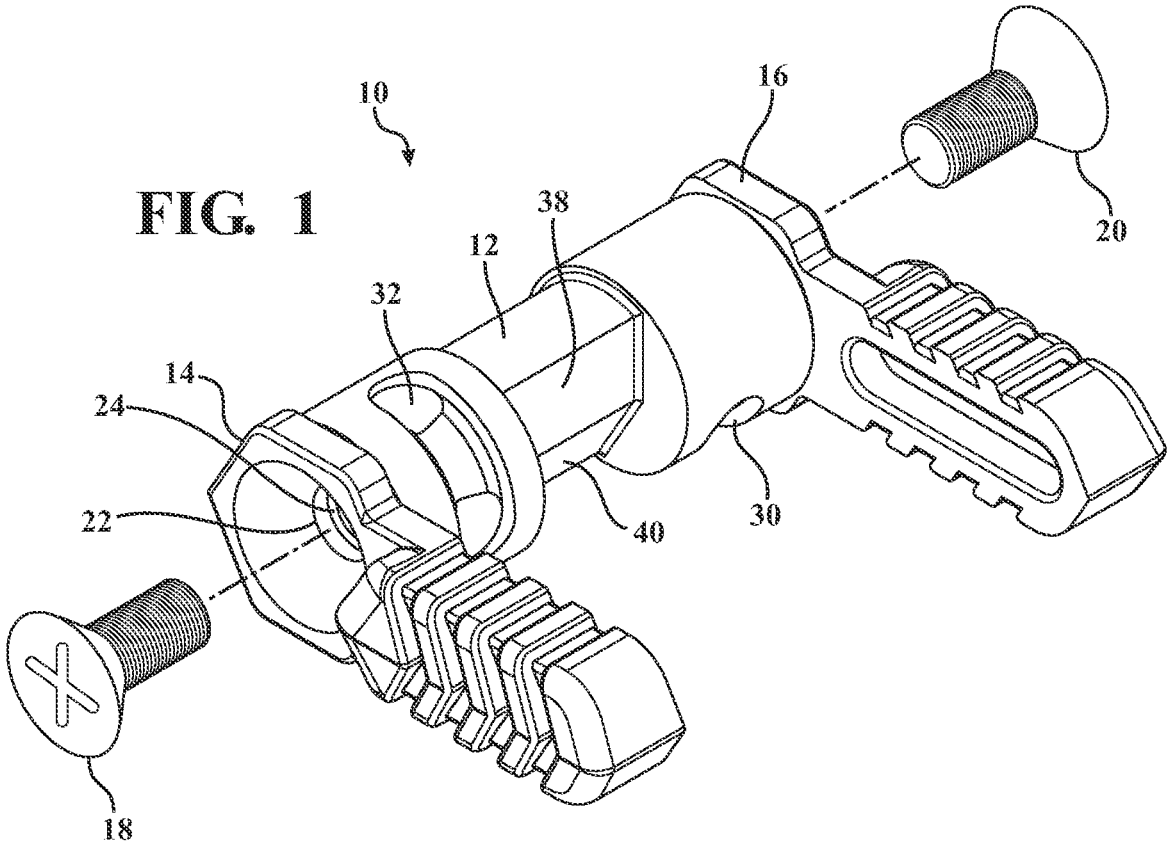
FIG. 1 is a perspective view of an ambidextrous safety selector according to an embodiment of the present invention.

Referring initially to FIG. 1, a perspective view is generally presented at 10 of an ambidextrous safety selector according to an embodiment of the present invention. As previously described, the present invention discloses a dual lever ambidextrous and reversible safety selector switch for a firearm including each of a central rotatable and modified (or pseudo-cylindrical shaped) component 12 along with a pair of end attachable levers 14 and 16.

Without limitation, the levers 14/16 can be secured to the opposite ends of the central component 12 utilizing screws 18/20 which mount through aligning apertures established between the pivotally supported head portion of the lever (see aperture 22 of lever 14 in FIG. 1) and an aligning and interiorly threaded aperture 24 associated with the opposing end surface of the central selector component). It is also envisioned and understood that either of the levers 14 or 16 can be permanently attached to the central selector 12 and so that, upon removal of the other lever, the selector can be removed, rotated and reinstalled through the other side of the lower receiver (see again FIGS. 13-14) and in order to switch between each of the normal throw and short throw selector options.

Figure 2:
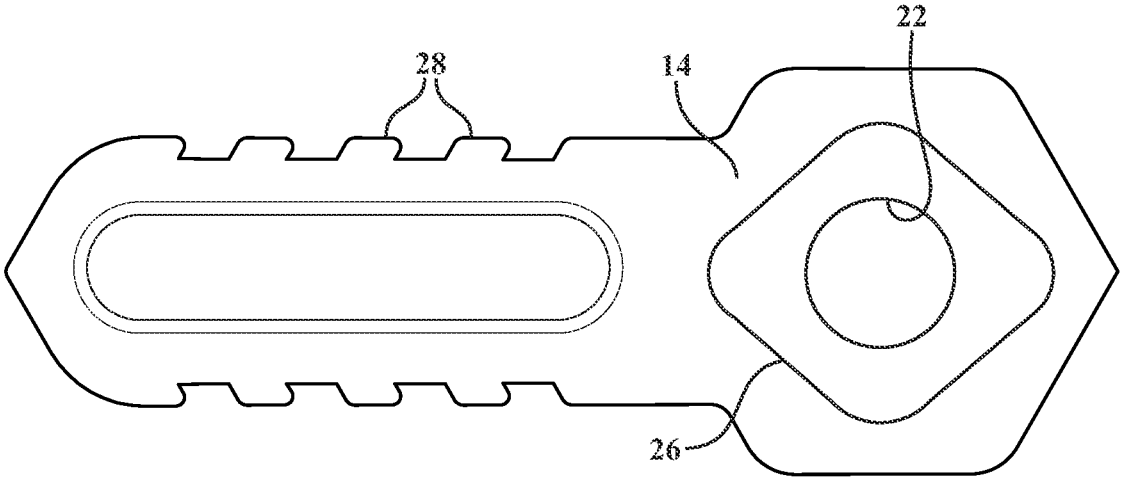
FIG. 2 is a rotated and inside plan view of a disassembled lever component of the safety selected of FIG. 1.
Figure 19:
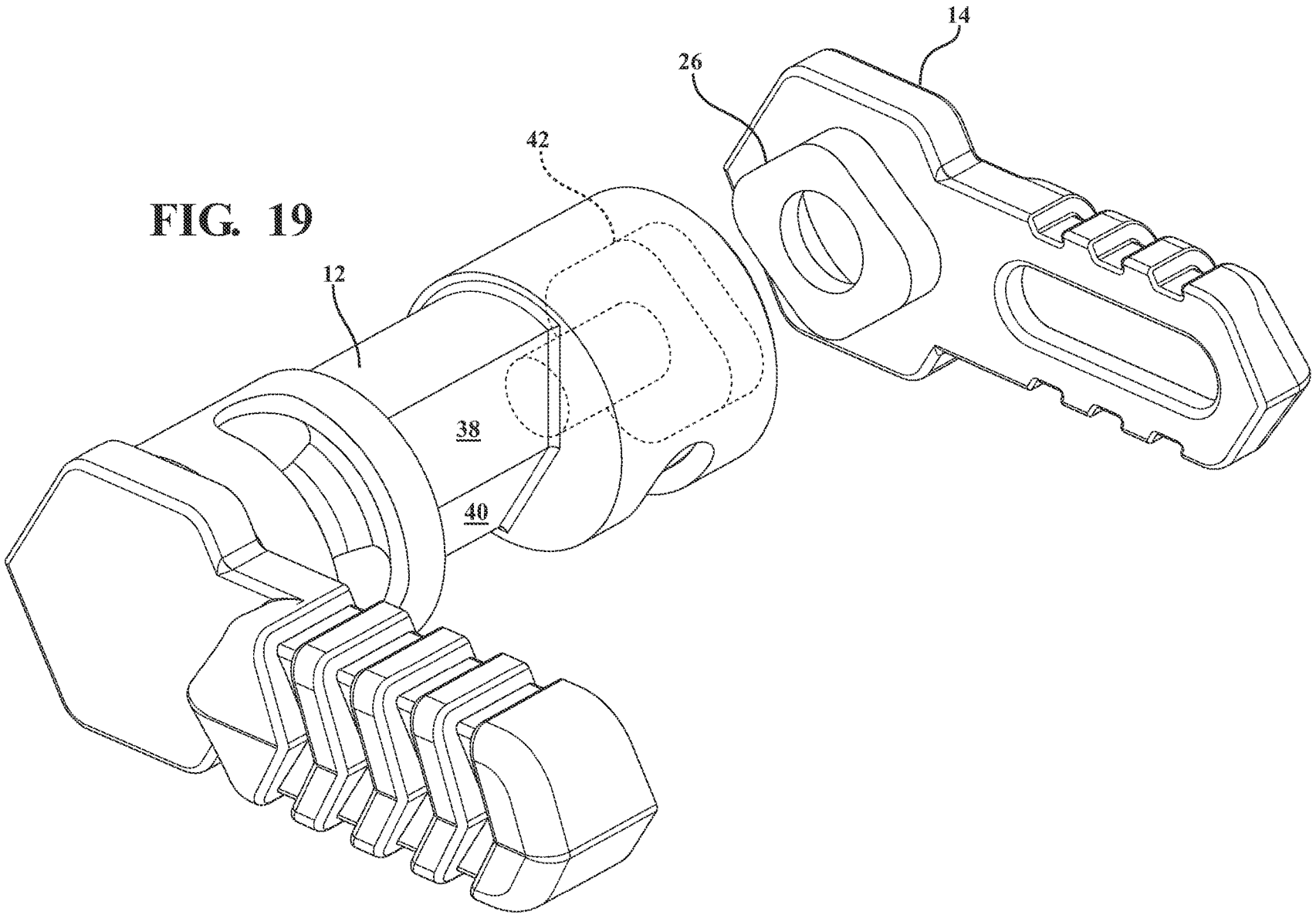
FIG. 19 is an illustration of a revised selector in which one of the levers is integrated into the selector component.

FIG. 2 is a rotated and inside plan view of a disassembled lever component (again at 14) of the safety selected of FIG. 1 and depicting a pseudo diamond shaped outline 26 corresponding to an inside protuberance configured on the rotatable head of the lever component (see also as shown in FIG. 19) for engaging the opposing recessed end profile on the central safety selector 12. As will be further described, the present invention envisions alternative configurations based on user preferences for maintaining rigid retention of the throw levers to the opposite end of the central selector. As further shown, the design of the levers 14/16 can be varied for both purposes of ergonomic grip and aesthetics and, in the illustrated embodiment, includes an exterior keyed pattern (at 28) configured upon either or both sides of the elongated edges of the lever to assist in maintaining a tactile grip on the lever during rotation of the selector.

Figure 3:
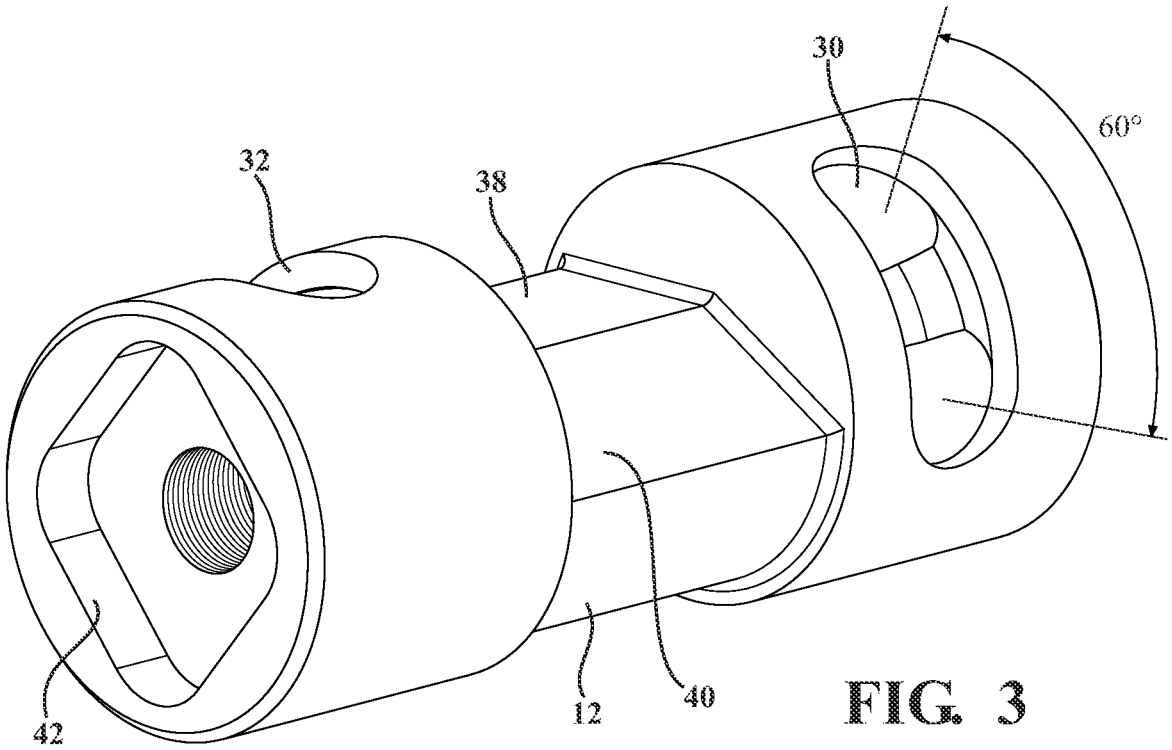
FIG. 3 is a perspective view of the central safety selector component arranged in a shortened sixty degree rotation or "throw" configuration.
Figure 4:
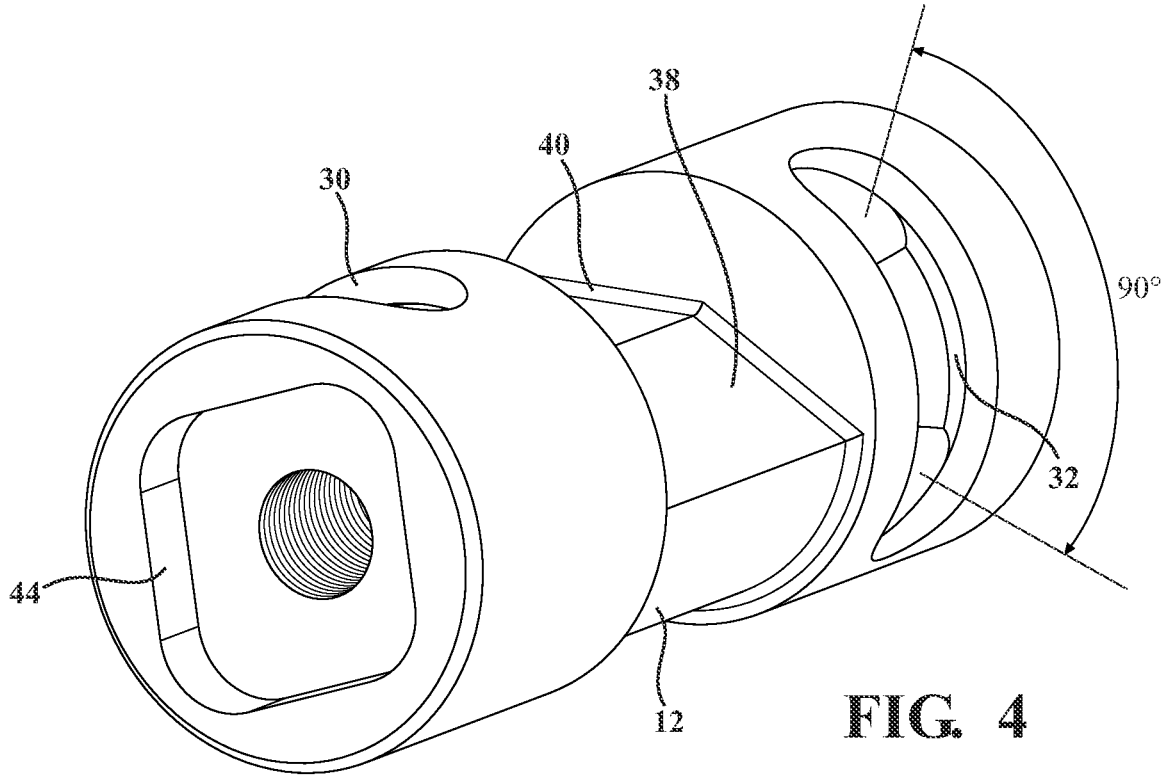
FIG. 4 is a perspective view of the central safety selector component rotated to a standard ninety degree "throw" configuration.

Referring to each of FIGS. 3-4 first and second perspective views are provided of the central safety selector component arranged in each of a shortened sixty degree rotation or "throw" configuration (FIG. 3) as well as a standard ninety degree "throw" configuration (FIG. 4). The central shaft includes each of first 30 and second 32 arcuate slots configured along opposite ends and in an arcuate or circumferentially directed manner.

Each of the slots 30 and 32 exhibits a seating detent located at each of opposite ends of the circumferential extending arc (see as best depicted in succeeding FIG. 11 by end detent locations 34 and 36 associated with arcuate slot 30) and, depending upon the mounting configuration of the selector within the lower receiver, will permit a selected angular range of rotation (e.g. standard 90° degree throw in a first mounting configuration utilizing standard slot 32 or a modified short throw rotatable only 60° in a second mounting configuration utilizing slot 30), and at which the spring loaded detent pin (again at 8 in FIG. 14) in the lower receiver seats within one of the configured slots 30 or 32 for displacement between the end detents.

The central shaft selector further includes an angular profile provided by a pair of angled faces 38/40 or surfaces positioned between the arcuate ninety (32) and sixty (30) degree end slots and, depending upon the adjusted rotational position of the selector, will either obstruct or provide the necessary clearance for the rear extending portion of the trigger (see again at 6 in FIG. 13) for in turn actuating the disconnector 4 and hammer 5 components of the lower receiver trigger group in order to discharge a cartridge (not shown) in the attached upper receiver of the AR style firearm. As further best shown in FIG. 1, the slots 30/32 are configured into outermost diameter integral end portions of the central selector 12, with the angled trigger engaging faces 38/40 configured in a somewhat reduced diameter central interior area for purposes for providing correct engagement and clearance tolerances of the selector when actuated between the "safe" and "fire" positions.

Figure 5:
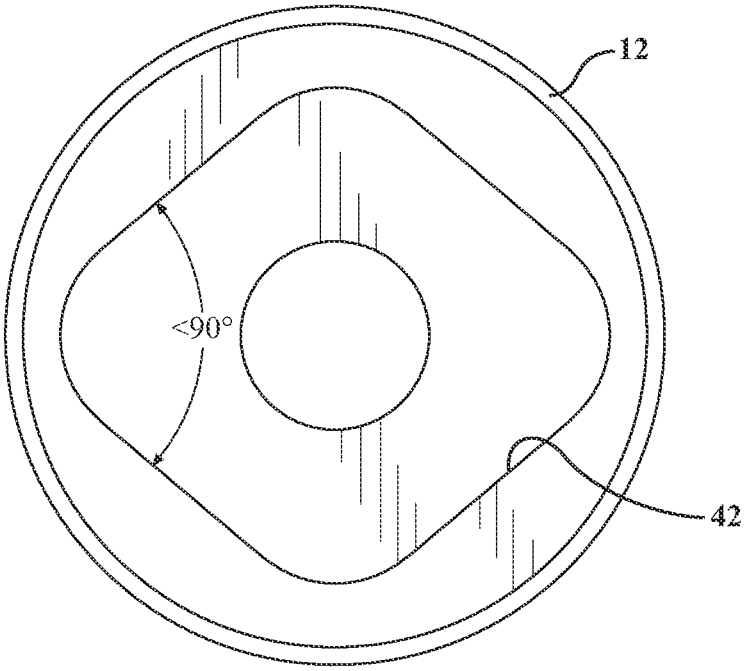
FIG. 5 is a side plan view illustration of the central safety selector component with the attachable levers removed and depicting the pseudo and interior diamond shaped and interior recess profile configured within the selector.
Figure 6:
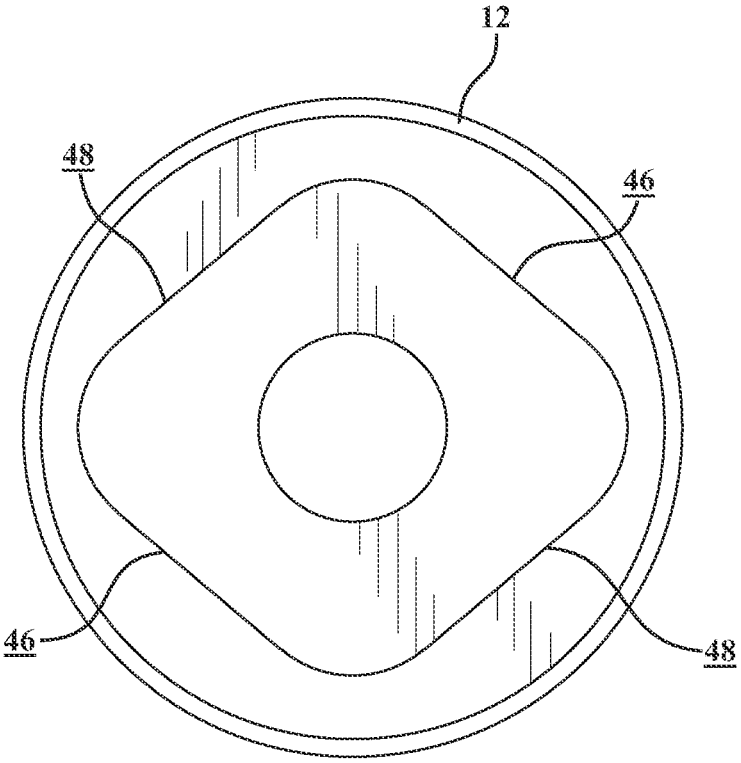
FIG. 6 is a corresponding view to FIG. 5 and further depicting the unequal widths of the parallel walls defining the interior recessed and pseudo diamond profile configured into the opposite ends of the central safety selector component.

With reference to each of FIGS. 5-6, a pair of side plan view illustrations are provided of the central safety selector component 12, with the attachable levers removed for depicting a receiving recessed profile 42/44 configured into the opposite ends of the component 12 (the recessed profile 42 also again shown in FIG. 3, with the opposing end recess profile 44 shown in FIG. 4). Each end recessed profiles 42 and 44, in one non-limiting embodiment, exhibits a pseudo or modified diamond shaped or other similar internal profile denoted by at least a pair of acute angles on two of its corners, and which can further be either of straight or rounded corners. The acute angles defined at the corners can further include, without limitation, a range of 80° to less than 90°). Without limitation, the corners can each also be straight or sharp-edged in combination with having at least one or more being acute angled.

The widths of the respective pairs 46 and 48 of opposing walls can be the same in order to define such as a generally pseudo diamond shaped profile. Alternatively, the widths of the respective walls 46/48 in other embodiments can be envisioned to vary incrementally and so as to cover other profiles not limited to a pseudo-trapezoidal shape and, again, having at least a pair of the corners with acute angles.

FIG. 6 is a corresponding view to FIG. 5 of diamond shaped recess 42 and further depicting the pairs of parallel walls (see at 46 and 48) for defining the interior recessed and generally diamond profile configured into each of the opposite ends of the central safety selector component 12. Without limitation, the multi-sided end profiles 42/44 (along with the corresponding profiles 26 configured into the opposing seating locations of the attachable levers) can be differentiated from any squared, right-angled or cuboidal end profile.

The widths of the parallel walls are again, in a non-limiting embodiment, depicted as being equal. The opposing inner projection of the lever 14 (see again pseudo diamond shaped outline 26 in FIG. 2) can also (without limitation) exhibit mismatched widths to facilitate seating of the levers 14 and 16 against the ends of the central element 12 so that its screw (again 18 or 20) aligns it to the centered orientation when installed. In this manner, the mating boss or protrusion on the inside face of the lever (see again at 26 in FIG. 2) ensures that the lever can only be installed in two orientations that are one hundred eighty degree opposite from each other.

Additional variants envision reversing the arraignment of the recessed ends 42/44 in the central rotatable component 12 and the opposing seating inner profile of the outer levers 14/16, and so that the diamond shaped end recesses 42/44 are inverted and project outwardly from the opposite end faces of the central component 12. In this arrangement, the pseudo diamond shaped projecting outline 26 configured upon the inner face of the lever 14/16 can be likewise reversed so that it is recessed into the inside surface of the lever 14. It is further understood that the thickness of the lever can further be varied from that shown according to the dimensional requirements for supporting the levers in end secured fashion against the central element in either of the one hundred degree eighty degree offset arrangements and during installation of the associated mounting screw.

Figure 7:
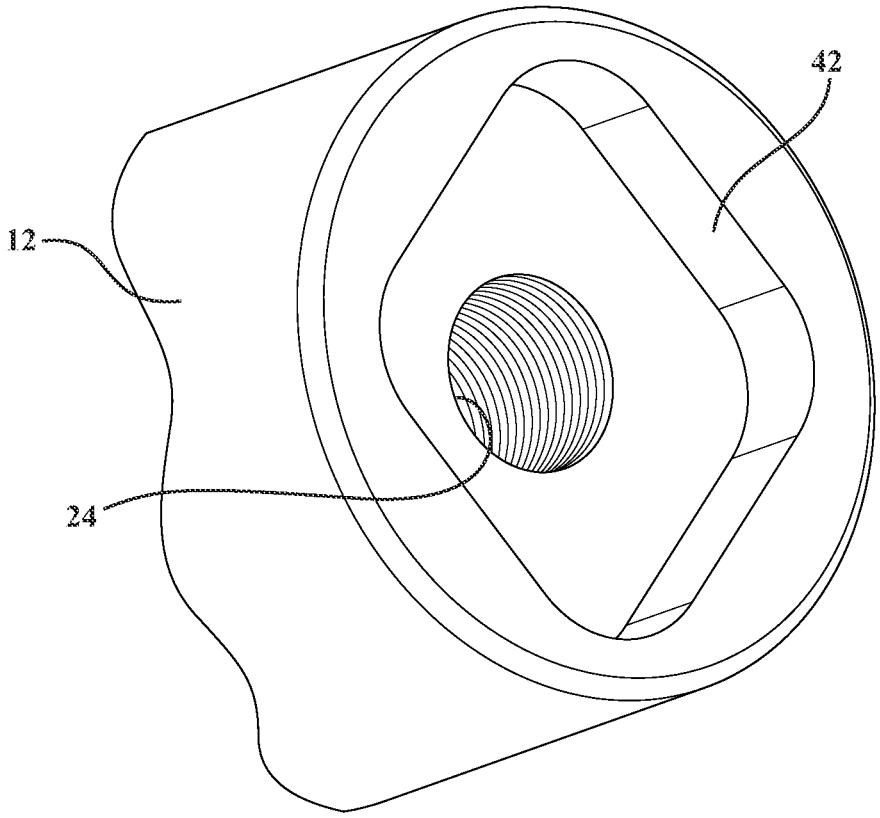
FIG. 7 is a partial end perspective of the central selector component of FIGS. 5-6 and better showing threaded hole for receiving the attachment screw for mounting the exterior lever.
Figure 8:
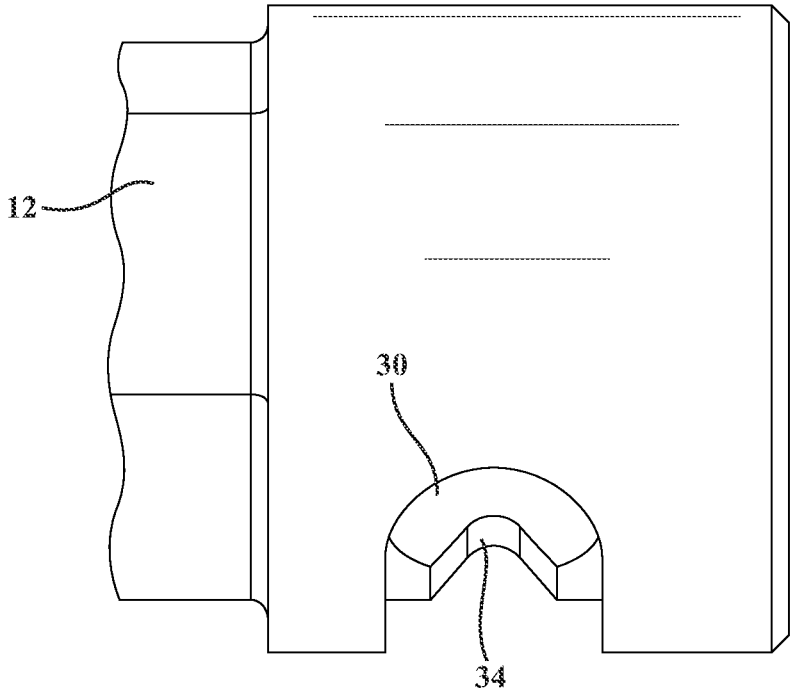
FIG. 8 is a rotated sectional plan view depicting a selected arcuate slot for receiving the lower receiver spring and including an end-seating detent recess for defining either of the "safe" or "fire" positions.

FIG. 7 is a partial end perspective of the central selector component of FIGS. 5-6 and better showing threaded hole (compare again to 24 as also shown in FIG. 1) for receiving the attachment screws 18/20 for mounting the exterior lever. FIG. 8 is a rotated sectional plan view depicting a selected arcuate slot (such as at 30 for representing a short throw situation) and for receiving the lower receiver spring and including an end-seating detent recess for defining either of the "safe" or "fire" positions as previously described.

Figure 9:
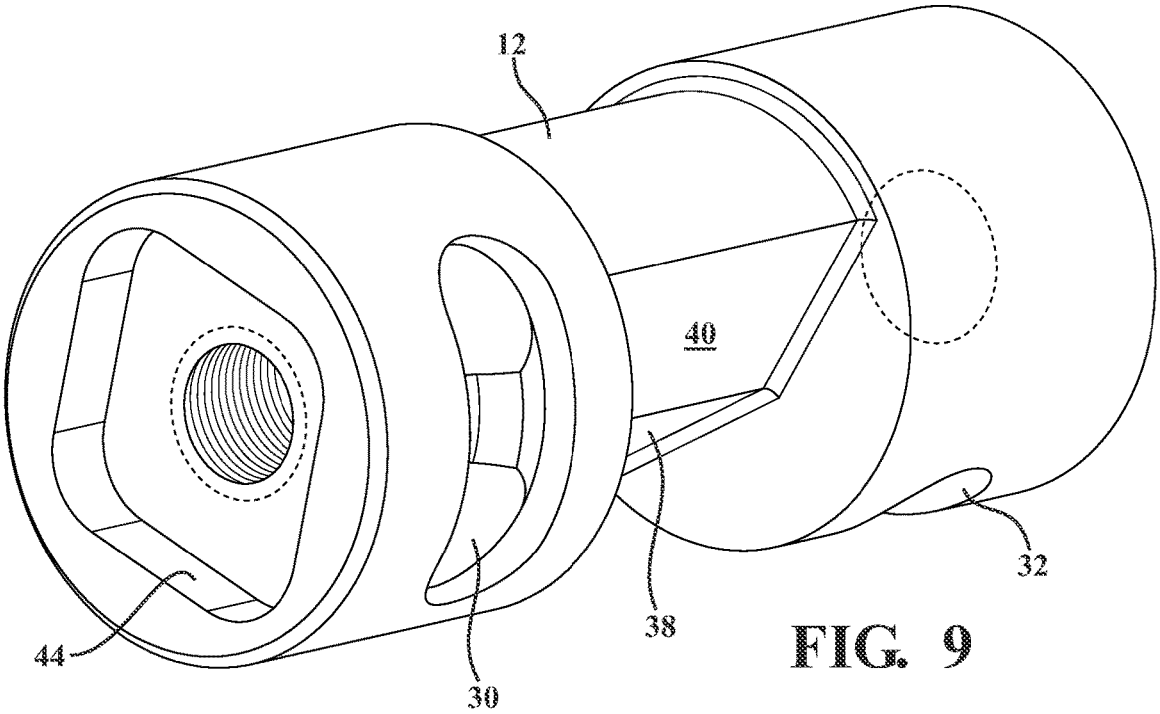
FIG. 9 is an enlarged perspective view of the rotatable central selector component similar to that shown in FIGS. 3-4.
Figure 10:
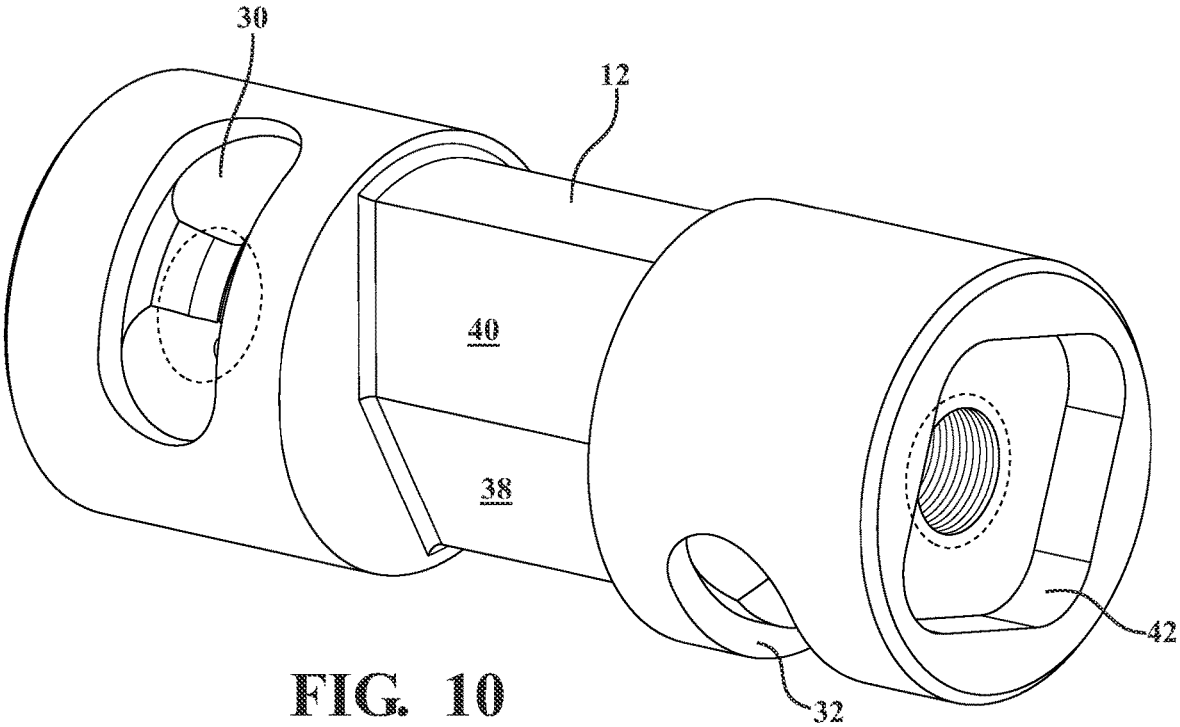
FIG. 10 is a further illustration similar to FIG. 9 in a rotated angular orientation.
Figure 11:
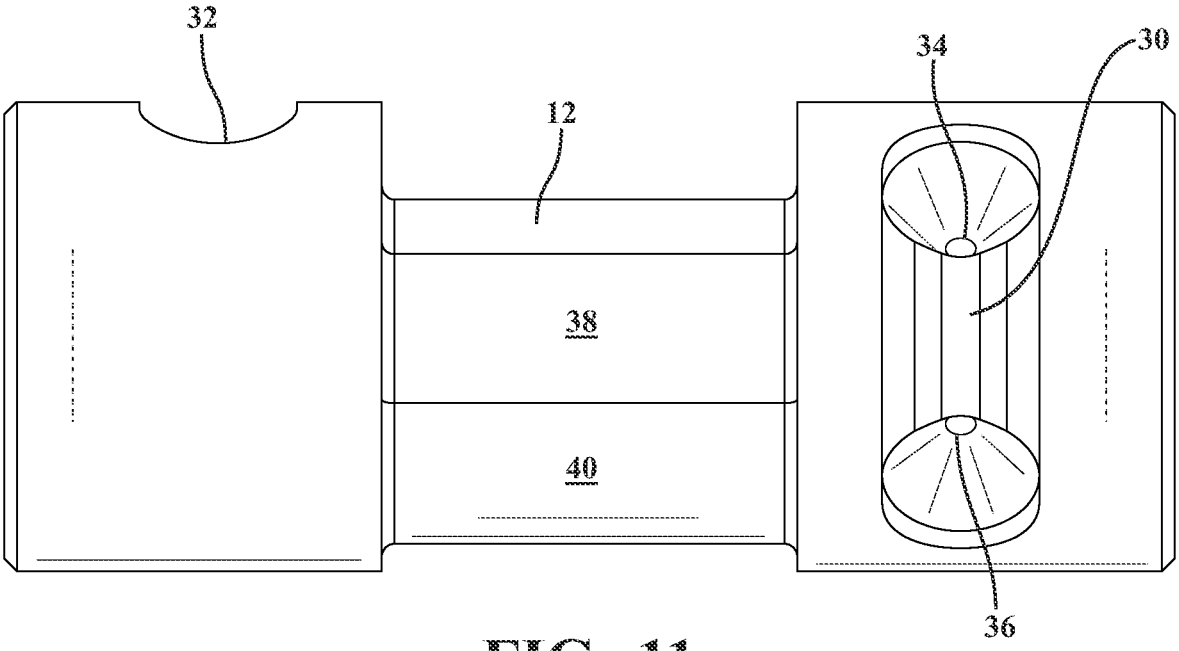
FIGS. 11-12 present first and second rotated plan views of the central selector component and depicting the circumferential directed end slots for receiving the spring loaded lower receiver detent pin, along with opposite end located detent recesses for defining the "safe" and "fire" positions.
Figure 12:
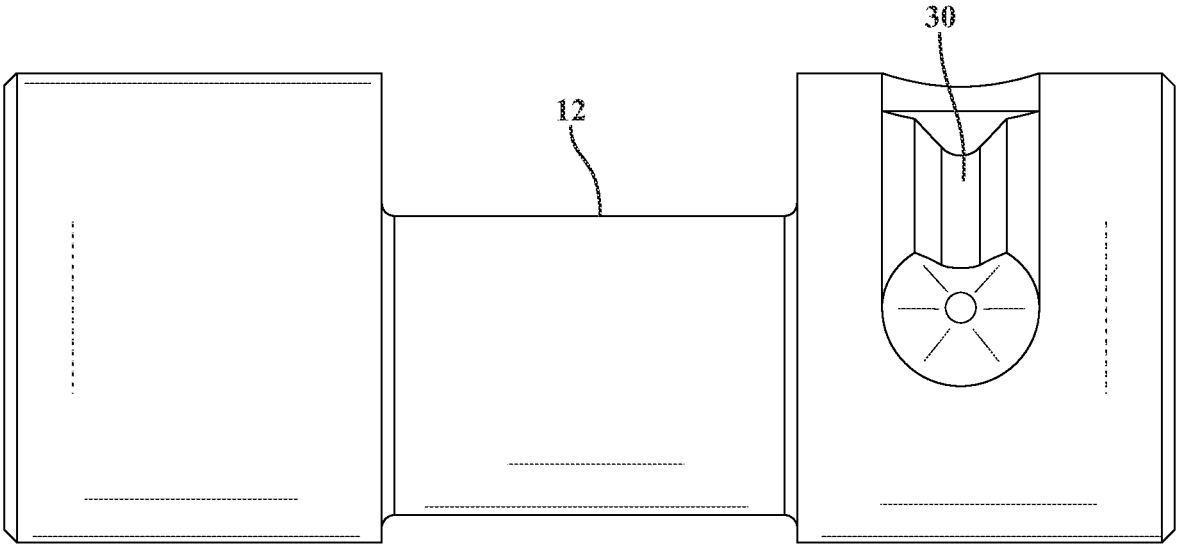

FIG. 9 is an enlarged perspective view of the rotatable central selector component similar to that shown in FIGS. 3-4, with FIG. 10 providing is a further illustration similar to FIG. 9 in a rotated angular orientation. FIGS. 11-12 present first and second rotated plan views of the central selector component 12 and depicting the circumferential directed end slots (again at 30 and 32) for receiving the spring loaded lower receiver detent pin (again at 8 in FIG. 14), along with opposite end located detent recesses for defining the "safe" and "fire" positions.

Accordingly, and as previously described, the selector 10 is installed in the lower receiver so that the spring loaded detent pin in the receiver engages a selected one of the detent grooves or slots 30 or 32 to prevent rotation. In the first standard throw installed configuration, and upon exerting a specified force upon the lever to unseat the spring loaded pin from an end located detent in the first arcuate slot (see again by example end located detent recesses 34/36 associated with selected groove or slot 30) corresponding to the "safe" position, rotation of the shaft is permitted between "safe" and "fire" positions over a given range of rotation, at which, and upon the receiver mounted spring pin engaging the opposite end located detent pin configured within the given slot. Upon the selector being removed and re-installed in a reversed arrangement within the receiver, the spring loaded pin seats within a corresponding end detent of the other arcuate slot, following which rotation of the selector is permitted over either of a standard or reduced travel, at which the spring loaded pin seats within a second end located detent.

Figure 15:
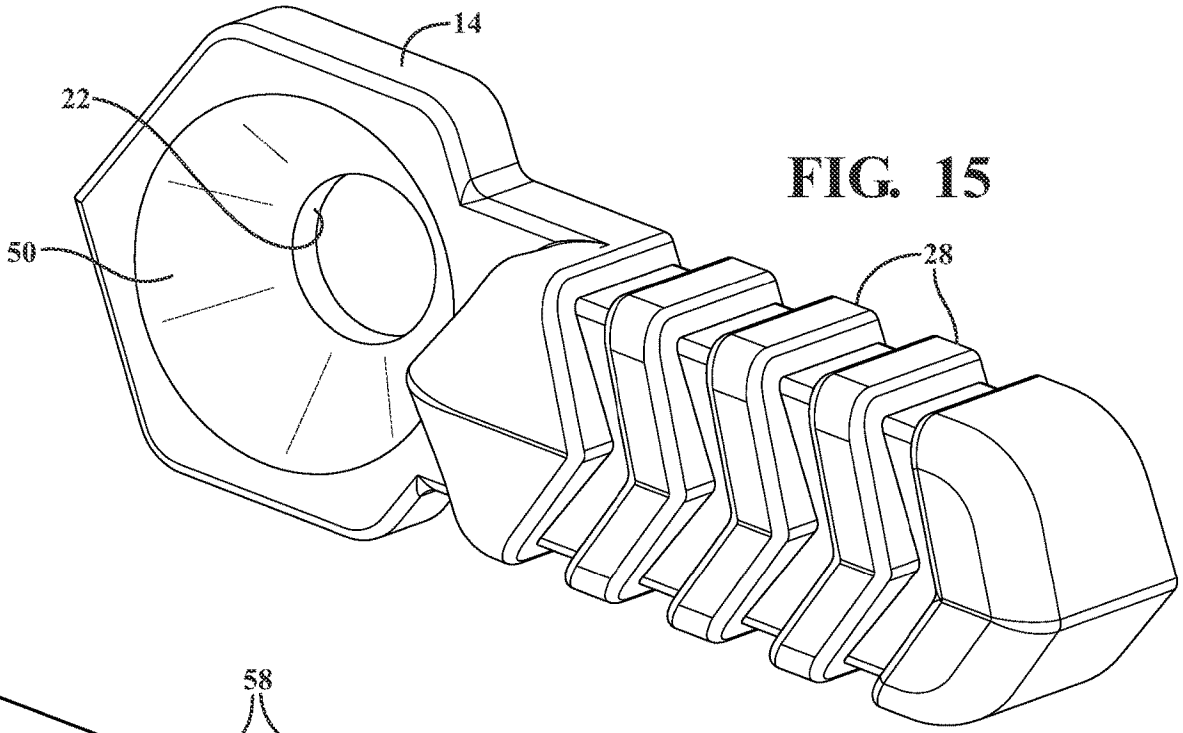
FIG. 15 is an exterior perspective of the lever depicted in FIGS. 1-2 removed from the central rotatable component

Referring now to FIG. 15, an illustration is shown of an exterior perspective of the lever 14, such as depicted in FIGS. 1-2 and removed from the central rotatable component 12. The aperture 22 and exterior keyed pattern 28 are again depicted, as is a concave recess 50 configured on an exterior facing head portion of the lever 14 which surrounds the recess 22 and through which is inserted the engaging screw 18 shown in FIG. 2.

Figure 16:
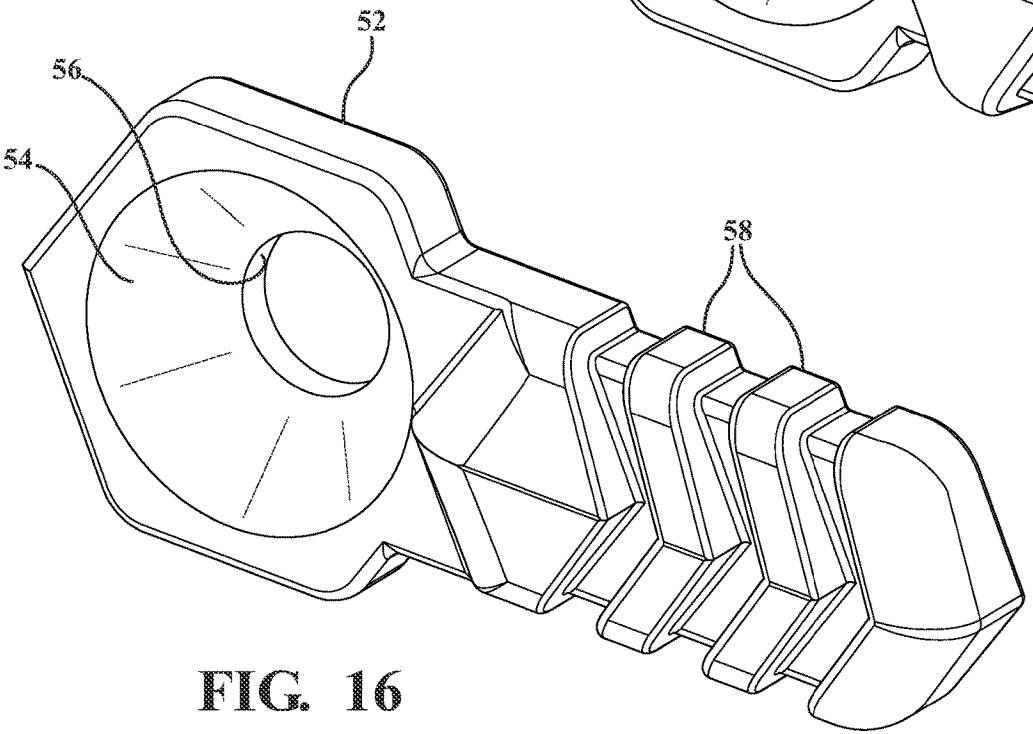
FIG. 16 is a perspective illustration of a further sub-variant of lever, similar to that shown in FIG. 15, and having both a reduced length and thinner cross sectional profile in comparison to that shown in FIG. 1.
Figure 17:
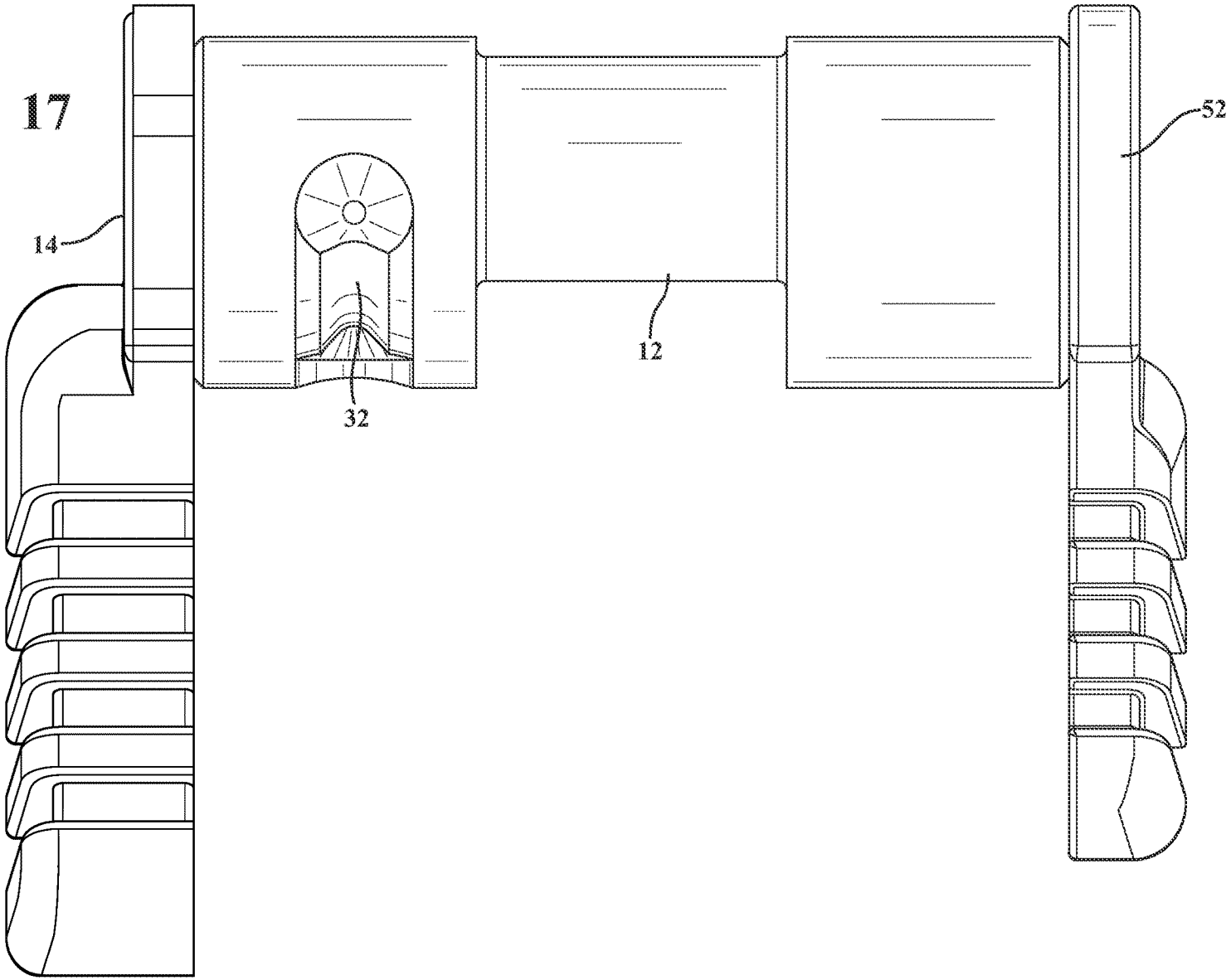
FIG. 17 is an overhead two dimensional view depicting for comparison purposes both variants of levers depicted in FIGS. 15 and 16 secured to a central rotatable component.

FIG. 16 is a perspective illustration of a further sub-variant of a lever, at 52, similar to that shown in FIG. 15, and having both a reduced length and thinner cross sectional profile in comparison to that shown in FIG. 1. This is better shown by the overhead two dimensional view of FIG. 17 depicting for comparison purposes both variants of levers 14 and 52 depicted in FIGS. 15 and 16 secured to opposite ends of a central rotatable component 12.

The smaller/thinner lever 52 otherwise includes a similar pattern to that shown in the lever 14 of FIGS. 1-2 and 15, with each of a concave recess 54 communicating with an aperture 56 for receiving the mounting screw 18/20 (again so that the threaded shaft of the screw passes through the aperture to engaging the threaded interior of the central rotatable component and the enlarged head seats flush within the concave recess. Other features include the keyed exterior pattern (at 58 in FIG. 16) configured upon the lever 52 for assisting in ergonomic grip. Beyond that shown, it is understood that the design of the lever component can be varied from that shown and without departing from the scope of the invention.

Other envisioned variants include presenting a modified ambi-selector in which one of the levers 14/16 is formed in one piece with the central rotatable element 12 (this is depicted in reference to FIG. 19 below). Upon installation of the central component 12 within the firearm lower receiver 2 from either side, the integrated lever abuts against the indicated side of the receiver, with the separate lever (again the other of either such as shown at 14 or 16 and in particular at 14 in FIG. 19), and which is then secured against the exposed opposite end of the rotatable element, again utilizing a screw or the like.

Figure 18:
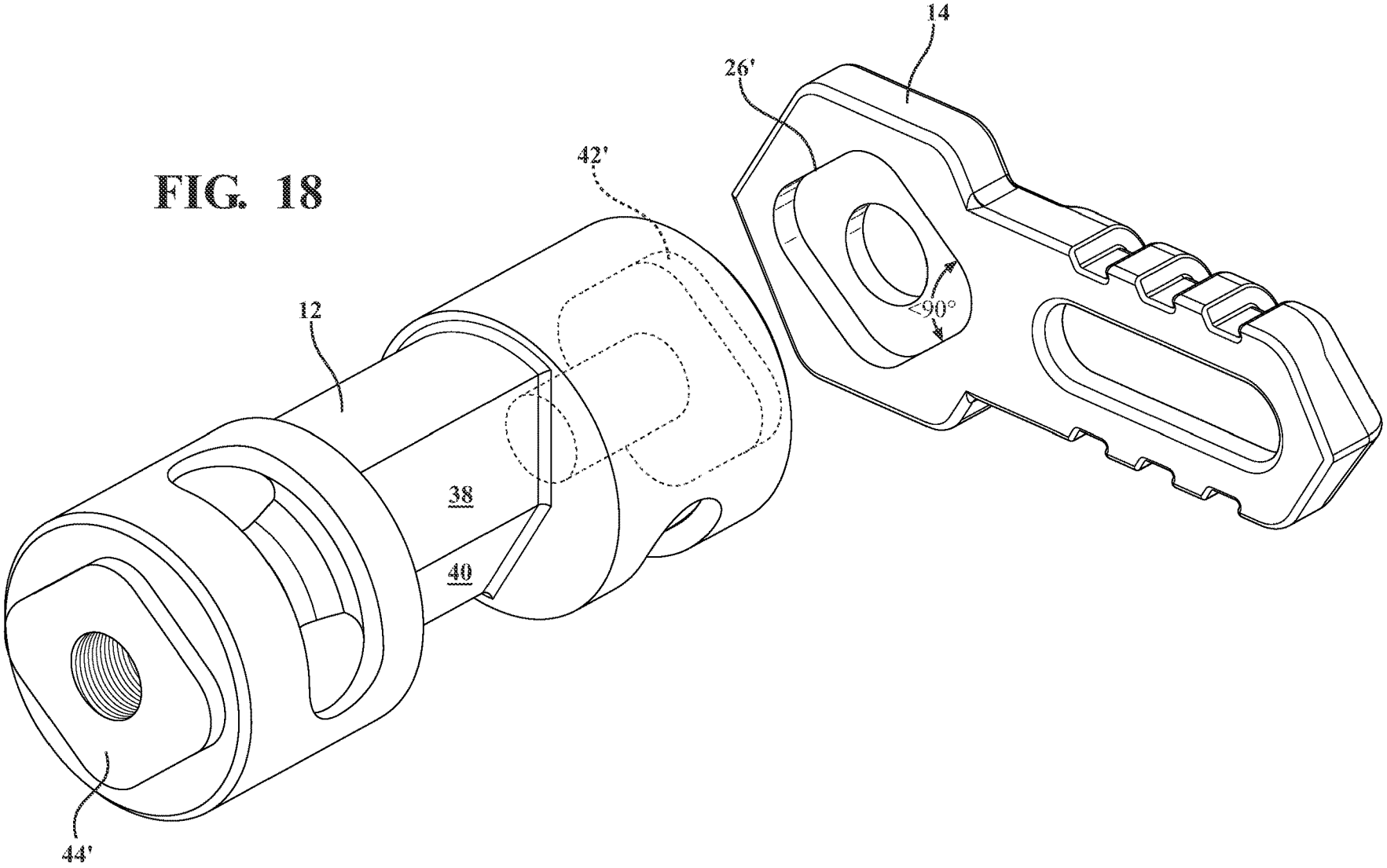
FIG. 18 is an exploded view of a partial ambidextrous safety selector according to a further preferred embodiment and depicting an inverted arrangement in which the end recess on the safety selector component is reconfigured as a similarly shaped projection, with the keyed diamond projection on the inside of the inside face of the lever is reconfigured as a recess.

Additional variants can also include configuring either of mating diamond shaped recesses or projections into the opposing surfaces of the lever and central component as previously described. This is best shown in FIG. 18 which provides an exploded view of a partial ambidextrous safety selector according to a further preferred embodiment and depicting an inverted arrangement in which the end recess on the safety selector component is reconfigured as a similarly shaped projection (see as shown in phantom at 42' as well as at 44'), with the keyed diamond projection on the inside of the inside face of the lever conversely being reconfigured as a recess 26' as compared to the projection 26 as shown in the variant of FIG. 19. As previously depicted in FIG. 5, the mating corners of the opposing projections 42' and recesses 26' defined in each of the central shaft and the end-attachable levers can include either of straight or curved edge configuration and so that the corners of each define an acute angle not limited to a range of 80° to less than 90°.

Having described my invention, other and additional preferred embodiments will become apparent to those skilled in the art to which it pertains, and without deviating from the scope of the appended claims. The detailed description and drawings are further understood to be supportive of the disclosure, the scope of which being defined by the claims. While some of the best modes and other embodiments for carrying out the claimed teachings have been described in detail, various alternative designs and embodiments exist for practicing the disclosure defined in the appended claims.

The foregoing disclosure is further understood as not intended to limit the present disclosure to the precise forms or particular fields of use disclosed. As such, it is contemplated that various alternate embodiments and/or modifications to the present disclosure, whether explicitly described or implied herein, are possible in light of the disclosure. Having thus described embodiments of the present disclosure, a person of ordinary skill in the art will recognize that changes may be made in form and detail without departing from the scope of the present disclosure. Thus, the present disclosure is limited only by the claims.

In the foregoing specification, the disclosure has been described with reference to specific embodiments. However, as one skilled in the art will appreciate, various embodiments disclosed herein can be modified or otherwise implemented in various other ways without departing from the spirit and scope of the disclosure. Accordingly, this description is to be considered as illustrative and is for the purpose of teaching those skilled in the art the manner of making and using various embodiments of the disclosure. It is to be understood that the forms of disclosure herein shown and described are to be taken as representative embodiments. Equivalent elements, materials, processes or steps may be substituted for those representatively illustrated and described herein. Moreover, certain features of the disclosure may be utilized independently of the use of other features, all as would be apparent to one skilled in the art after having the benefit of this description of the disclosure. Expressions such as "including", "comprising", "incorporating", "consisting of", "have", "is" used to describe and claim the present disclosure are intended to be construed in a non-exclusive manner, namely allowing for items, components or elements not explicitly described also to be present. Reference to the singular is also to be construed to relate to the plural.

Further, various embodiments disclosed herein are to be taken in the illustrative and explanatory sense, and should in no way be construed as limiting of the present disclosure. All joinder references (e.g., attached, affixed, coupled, connected, and the like) are only used to aid the reader's understanding of the present disclosure, and may not create limitations, particularly as to the position, orientation, or use of the systems and/or methods disclosed herein. Therefore, joinder references, if any, are to be construed broadly. Moreover, such joinder references do not necessarily infer that two elements are directly connected to each other.

Additionally, all numerical terms, such as, but not limited to, "first", "second", "third", "primary", "secondary", "main" or any other ordinary and/or numerical terms, should also be taken only as identifiers, to assist the reader's understanding of the various elements, embodiments, variations and/or modifications of the present disclosure, and may not create any limitations, particularly as to the order, or preference, of any element, embodiment, variation and/or modification relative to, or over, another element, embodiment, variation and/or modification.

It will also be appreciated that one or more of the elements depicted in the drawings/figures can also be implemented in a more separated or integrated manner, or even removed or rendered as inoperable in certain cases, as is useful in accordance with a particular application. Additionally, any signal hatches in the drawings/figures should be considered only as exemplary, and not limiting, unless otherwise specifically specified.

The invention claimed is:

1. A reversible safety selector for a firearm having a lower receiver, comprising:

a rotatable component mounted through a transverse extending aperture within the lower receiver;

first and second circumferentially directed slots configured within opposite sides of said component, each of said slots exhibiting a seating detent at each of opposite ends so that, upon installing said component in a given orientation within the lower receiver, a spring loaded detent pin supported in the lower receiver projects within said transverse aperture in seating fashion within a selected one of said slots, rotation of said component causing displacement of said detent pin between each of "safe" and "fire" configurations;

at least one end face of said component further exhibiting either of a recessed or a projecting multi-sided shape including a four sided profile with rounded corners, at least a pair of said corners defining acute angles;

a pair of control levers supported at opposite ends of said component, at least one of said control levers having an opposite of a recessed or a projecting multi-sided shape configured upon or within an inside face for mating said at least one of said control levers against said at least one end face of said component; and a screw inserting through an aperture in said at least one of said control levers and engaging mating threads configured within an aligning aperture defined in said component, said levers being manipulated from either side of the lower receiver for actuating the selector.

2. The safety selector of claim 1, said first circumferentially directed slot further comprising a ninety degree range of rotation.

3. The safety selector of claim 1, said second circumferentially directed slot further comprising a sixty degree range of rotation.

4. The safety selector of claim 1, said rotatable component further comprising an angular profile having a pair of angularly oriented faces positioned between said opposite sides and, depending upon the adjusted rotational position of the selector, either obstructing or providing clearance for a rear extending portion of the trigger in turn actuating the disconnector and hammer components of the lower receiver trigger group in order to discharge a cartridge in the attached upper receiver of the firearm.

5. The safety selector of claim 1, said recessed or projecting multi-sided shape with rounded corners further comprising the attachable levers each incorporating a mating interior facing projection seats within said central shaft.

6. The safety selector of claim 1, said levers each further comprising a keyed exterior gripping profile.

7. The safety selector of claim 1, further comprising one of said levers being integrated into said rotatable component.

8. The safety selector of claim 1, said pair of acute angle defining corners having an angular range of 80° to less than 90°.

9. A dual lever ambidextrous and reversible safety selector switch for a firearm having a lower receiver, comprising:

a central and modified cylindrical shaped rotatable component which is pivotally mountable through a transverse aperture in the lower receiver for selective rotation relative the receiver;

said rotatable component including each of first and second circumferentially directed slots configured along opposite ends, each of said slots exhibiting a seating detent located at each of opposite ends of said slot and so that a spring loaded detent pin in the lower receiver seats within one of the configured slots for displacement between the end detents;

depending upon amounting configuration of said selector within the lower receiver, said detents permitting first and second varying ranges of rotation between each of "safe" and "fire" configurations;

opposite end faces of said central shaft further exhibiting a recessed four sided profile with a pair of acute-angle defining and rounded corners;

a pair of control levers supported upon said opposite end faces of said component, said control levers each having an opposing and projecting four sided profile configured upon an inside face thereof for mating with said recessed profiles in said end faces of said component so that either lever can be manipulated from either side of the lower receiver for actuating the selector; and screws inserting through apertures in said levers and engaging mating threads configured within aligning apertures defined in said sides of said component, said levers being manipulated from either side of the lower receiver for actuating the selector.

10. The safety selector of claim 9, said levers each further comprising a keyed exterior gripping profile.

11. The safety selector of claim 9, said acute angles further comprising a range of 80° to less than 90°.

12. A dual lever ambidextrous and reversible safety selector switch for a firearm having a lower receiver, comprising:

a central rotatable component which is pivotally mountable through a transverse extending aperture in the lower receiver of the firearm for selective rotation relative the receiver;

said rotatable component including each of first and second circumferentially directed slots configured within opposite sides, each of said slots exhibiting a seating detent located at each of opposite ends of said slots and so that a spring loaded detent pin in the lower receiver seats within one of the configured slots for displacement between the end detents, said circumferentially directed slots having different angular lengths relative to one another for establishing first and second varying ranges of rotation between each of "safe" and "fire" configurations;

a pair of levers, a first being integrated into said component, a second of said levers being separately attached to a selected one of said end faces via an attachable screw;

an exposed end face of said central shaft further exhibiting a recessed and internal four sided profile with a pair of acute-angle defining and rounded corners;

said second control lever having a projecting four sided profile configured upon an inside face for mating within said internal four sided profile of said rotatable component; and a screw inserting through an aperture in said second lever and engaging mating threads configured within an aligning apertures defined in said exposed end face of said component, said levers being manipulated from either side of the lower receiver for actuating the selector.

13. The safety selector of claim 12, said levers each further comprising a keyed exterior gripping profile.

14. The safety selector of claim 12, said acute angles further comprising a range of 80° to less than 90°.

15. The safety selector of claim 12, said first circumferentially directed slot further comprising a ninety degree range of rotation.

16. The safety selector of claim 12, said second circumferentially directed slot further comprising a sixty degree range of rotation.

* * * * *